US005310078A

United States Patent [19]

Strawder

[11] Patent Number: 5,310,078

[45] Date of Patent: May 10, 1994

[54] RECEPTACLE FOR SUPPORTING ADJACENT BAGS

[76] Inventor: Glenn G. Strawder, 11800 Beltsville Dr., #507, Beltsville, Md. 20705

[21] Appl. No.: 104,924

[22] Filed: Aug. 12, 1993

Related U.S. Application Data

[63] Continuation-in-part of Ser. No. 780,996, Oct. 23, 1991, abandoned, which is a continuation-in-part of Ser. No. 468,157, Jan. 22, 1990, Pat. No. 5,085,342, which is a continuation-in-part of Ser. No. 307,912, Feb. 9, 1989, Pat. No. 4,905,853.

[51] Int. Cl.[5] ..... B65D 90/04

[52] U.S. Cl. ..... 220/404; 220/254; 220/334; 220/908; 220/909

[58] Field of Search ..... 220/404, 908, 909, 254, 220/334; 248/95, 99, 100, 101

[56] References Cited

U.S. PATENT DOCUMENTS

| | | | |
|---|---|---|---|
| 199,507 | 1/1878 | Brubaker | 248/100 |
| 251,169 | 12/1881 | Bogue | 248/100 |
| 511,156 | 12/1893 | Newton | 220/908 X |
| 1,424,519 | 8/1922 | Richardson | 220/908 X |
| 2,206,421 | 7/1940 | Muehlhofer | 220/404 |
| 2,625,973 | 1/1953 | Weldon et al. | 220/404 X |
| 3,796,402 | 3/1974 | Trotta | 248/97 |
| 4,535,911 | 8/1985 | Goulter | 220/404 |
| 4,735,340 | 4/1988 | Preston | 220/404 |
| 4,750,638 | 6/1988 | Sosower | 220/404 |
| 4,867,328 | 9/1989 | McCarthy | 220/404 X |
| 4,874,111 | 10/1989 | Heller | 220/404 |
| 4,938,380 | 7/1990 | Donahoe | 220/404 |
| 4,964,523 | 10/1990 | Bieltvedt et al. | 220/254 X |
| 4,967,900 | 11/1990 | Gossett | 220/404 |
| 4,974,746 | 12/1990 | Dickinson | 220/404 |

*Primary Examiner*—Allan N. Shoap
*Assistant Examiner*—Stephen Cronin
*Attorney, Agent, or Firm*—William D. Hall

[57] ABSTRACT

A receptacle has projections extending from its upper end for supporting adjacent flexible plastic bags. At opposing positions on the receptacle there is a pair of closely adjacent projections at each of the opposing positions. In a round receptacle the opposing positions may be at opposite ends of a diameter. In a square or rectangular receptacle the opposing positions may be at opposite ends of a diagonal across the receptacle. One projection of each pair supports one bag and the other projection of each pair supports the other. Additional projections may be provided to assist in supporting the bags.

14 Claims, 2 Drawing Sheets

RECEPTACLE FOR SUPPORTING ADJACENT BAGS

RELATED APPLICATIONS

This application is a continuation-in-part of my prior copending Ser. No. 07/780,996 filed Oct. 23, 1991, now abandoned which was a continuation-in-part of my application Ser. No. 07/468,157, filed Jan. 22, 1990, now U.S. Pat. No. 5,085,342, granted Feb. 4, 1992. The aforesaid application Ser. No. 07/468,157 was a continuation-in-part of my application Ser. No. 07/307,912, filed Feb. 9, 1989, now U.S. Pat. No. 4,905,853, granted Mar. 6, 1990.

BACKGROUND OF THE INVENTION

The prior art teaches receptacles with projections extending from the open end for holding bags. The following two patents are examples:

McCarthy U.S. Pat. No. 4,867,328 teaches a sectionized receptacle comprising a receptacle with either a round or rectangular horizontal cross section for positioning a plurality of bags of flexible material and projections of which one or more are used to support and hold the upper open end of the bags. McCarthy teaches his projections as being adjacent the upper open end of the receptacle and that they extend vertically away from the receptacle.

Preston U.S. Pat. No. 4,735,340 teaches a trash bag bracket for use on trash receptacles comprising a group of two brackets which are attached to the upper open end of a receptacle and extend vertically upward and away from the open end for positioning and holding a bag of flexible material.

SUMMARY OF THE INVENTION

The invention relates to a receptacle for receiving at least two plastic flexible bags. At the upper end of the receptacle there are at least two pairs of projections. Each such pair of projections is mounted on the upper end of the receptacle, so that the bags carried by the two pairs of projections are adjacent each other in the receptacle. Thus in a square or rectangular receptacle the two pairs are mounted at opposite corners of the receptacle, respectively. Similarly, in a circular receptacle the two pairs may be mounted at opposite ends of a diameter of the receptacle. If, however, it is desired to have one bag larger than another the two pairs may be mounted along a line shorter than a diameter or shorter than the distance between opposing corners of a square or rectangular receptacle.

DETAILED DESCRIPTION OF THE INVENTION

Figure 1:
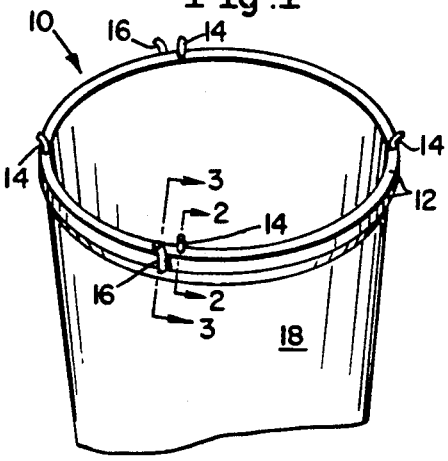
FIG. 1 is a persepective view of a receptacle constituting one form of the invention.
Figure 2:
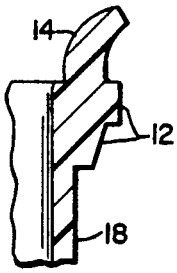
FIG. 2 is a cross section along line 2—2 of FIG. 1.
Figure 3:
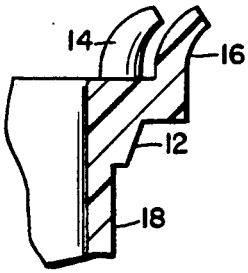
FIG. 3 is a cross section along line 3—3 of FIG. 1.

In FIG. 1, six projections 14, 14A, 16 are shown at the upper end of receptacle 18. These projections will hold two bags in the receptacle 18. For example, the three projections 4A may support one bag and projections 14 and 16 may support another bag. The fact that projections 14A and 16 are closely adjacent to each other results in the two bags being closely adjacent to each other.

The projections 14, 14A and 16 perforate the upper end of the bag and thereby hold the upper ends of the bags in place. It is not necessary, however, that the projections penetrate through the bags. It is usually sufficient if the bags are lapped over the projections. The lower ends of the bags either rest on the bottom of receptacle 18 or are held in the receptacle above the bottom thereof. The projections 14 and 14A are identical for their location on the receptacle.

The upper end of receptacle 18 includes an enlargement 12 to which projections 14, 14A and 16 are an integral part.

Figure 4:
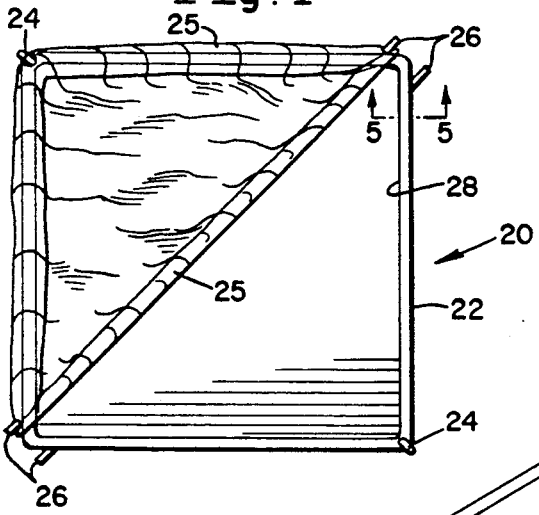
FIG. 4 is a top view of another form of the invention which has a plastic bag installed in the receptacle.
Figure 5:
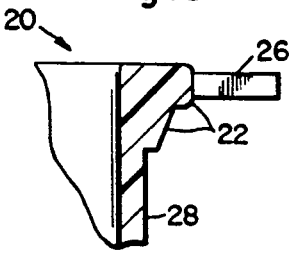
FIG. 5 is a cross section along line 5—5 of FIG. 4.

FIGS. 4 and 5 show a modified form of the invention. A rectangular receptacle 20 has a sidewall 28 having an enlargement 22 from which projections 24 and 26 project. As shown in FIG. 4, a bag 25 is held in position by two of the four projections 26 and one of the projections 24. A second bag may be held by the remaining projections 24 and 26.

Figure 6:
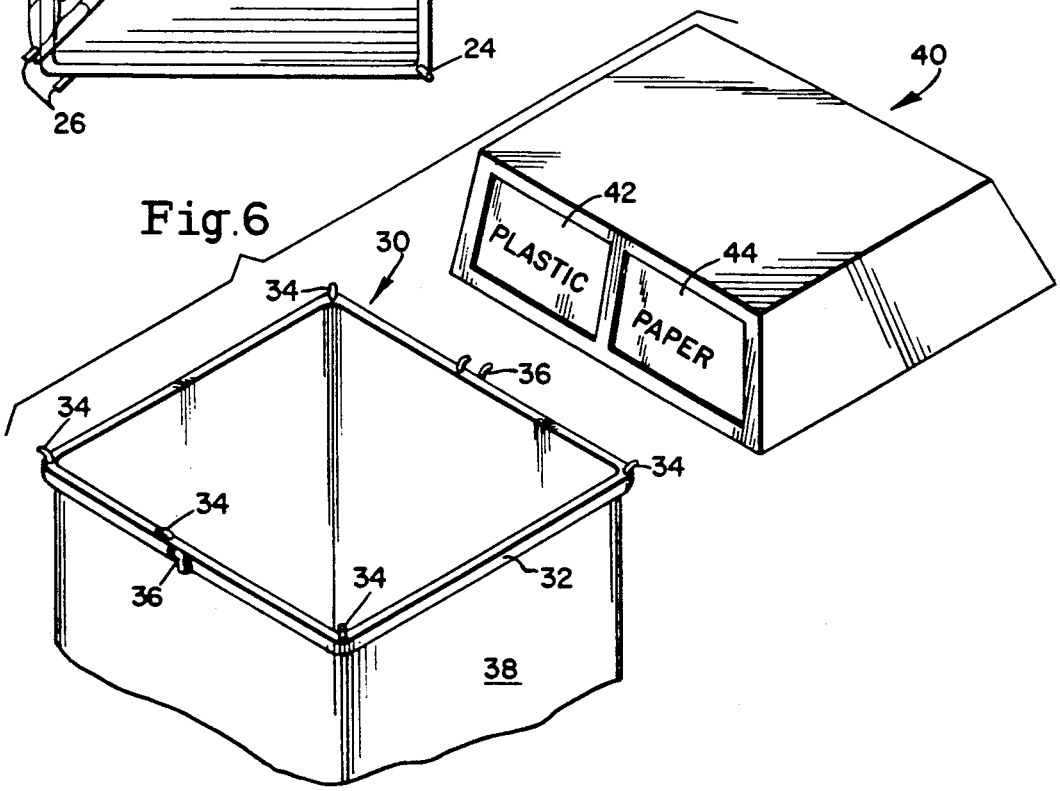
FIG. 6 is an exploded view of another form of the invention.

FIG. 6 illustrates a receptacle 38 having an upper rim 32. A lid 40 for the receptacle 38 has swinging lids 42 and 44 for plastic trash and paper trash, respectively. A plastic flexible bag for the paper trash may be carried on projections 34A and 36. A plastic flexible bag for the plastic trash may be carried on the four projections 34.

Figure 9:
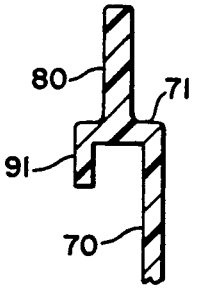
FIG. 9 is a sectional view taken along line 9—9 of FIG. 8.
Figure 10:
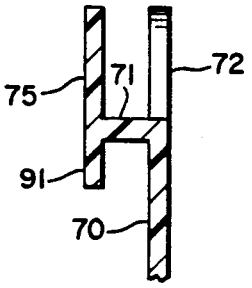
FIG. 10 is a sectional view taken along line 10—10 of FIG. 8.

Figure shows a modified form of receptacle for holding three bags. The receptacle 70 has the usual bottom that rests on the floor or other flat surface, and also has a sidewall of the shape shown in FIG. 7. There are four pairs of projections extending upwardly from the upper end 71 of the sidewall. A flexible plastic bag is shown hanging from projections 72, 73 and the upper end of the sidewall at 74. The projections 72, 73 are rectangular as shown in FIGS. 8, 9 and 10. The upper end of the sidewall, at 74, will act as a third support (in addition to the first and second supports 72 and 73) for the flexible plastic bag.

A second flexible bag (not shown) may be supported by projections 75, 76, 77 and 78 and a third flexible plastic (now shown) bag may be supported by projections 79, 80 and the left end 81 of the sidewall of the receptacle 71.

Figure 7:
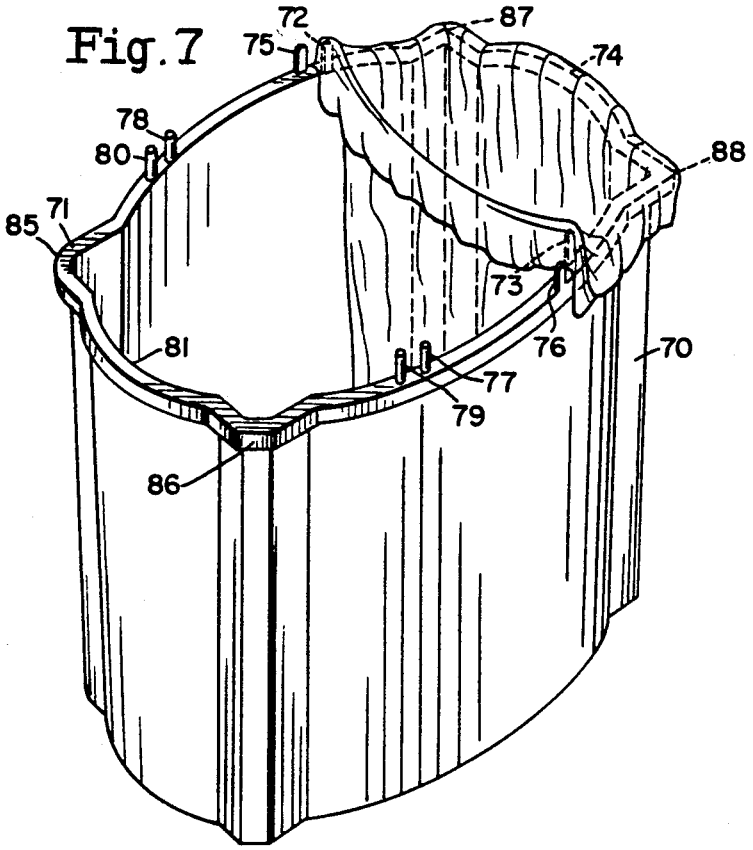
FIG. 7 is a perspective view of a modified form of the invention.
Figure 8:
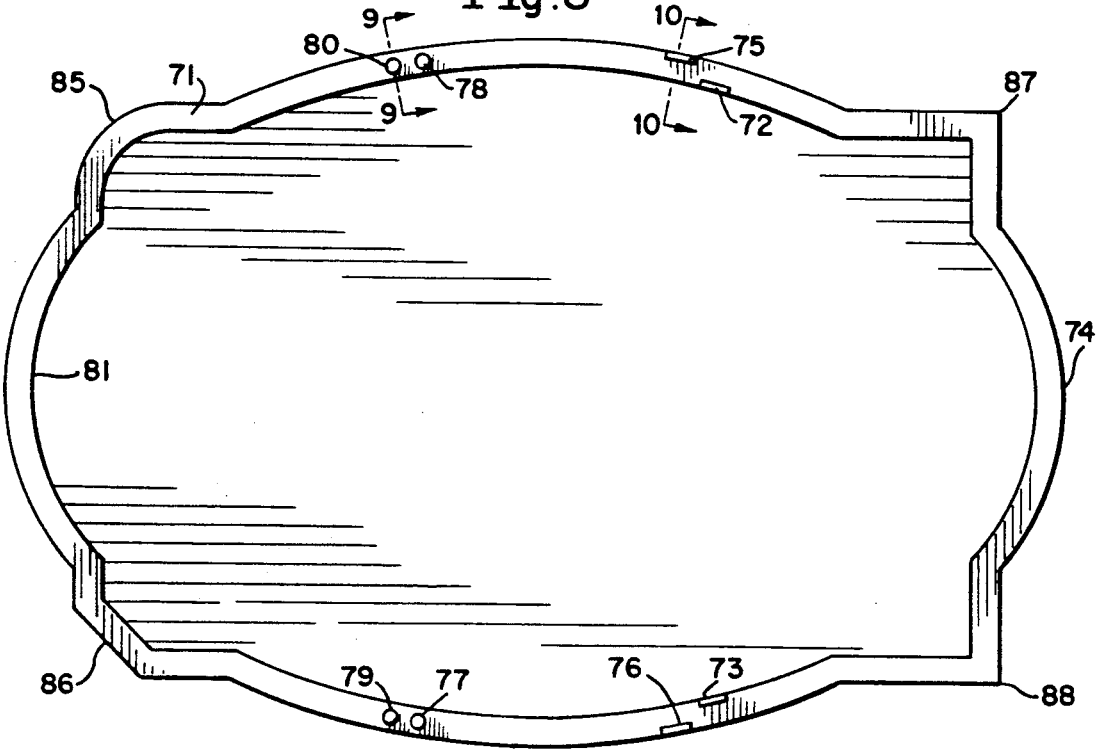
FIG. 8 is a top view of the modified form of FIG. 7.

As is in the case of the other embodiments of the invention, FIG. 7 has at least two pairs of adjacent projections with one projection of each pair holding one bag and the other projections of each pair holding a second bag; with the two bags adjacent each other in the receptacle.

The four corners 85, 86, 87 and 88, of the receptacle 70 show three different shapes that the upper end of the receptacle 70 may take. The corners 87 and 88 are square, the corner 85 is rounded and the corner 86 is flat. All four corners of any given receptacle may have one or more of these shapes. Each of these corners will act as a support for a bag in the receptacle.

The projections 72, 73, 75, 76, 77, 78, 79 and 80 may be molded integrally with the receptacle or they may be add-on devices. The rod-like projection 80 of FIG. 9 projects upwardly from upper end 71 which has a overhand 91. Similarly, projections 72 and 75 extend upwardly from upper end 71 which has overhang 91.

In this disclosure I hereby define the word "rectangular" to include—square—.

In all forms of the invention the entire receptacle including the several projections shown is molded in one piece.

In each of FIGS. 2, 3, 5 and 6 there is a geometric boundary for the upper end of the receptacle. Each of the projections 14, 16, 26, 34 and 36 is mounted on the geometric boundary of the receptacle.

I claim to have invented:

1. A device for holding at least two plastic bags each of which bags has an inner face and an outer face, comprising:

a receptacle having a bottom and also having a side wall extending upwardly from said bottom and having an upper end defining a geometric boundary, said side wall defining a single un-divided open cavity extending to at least the height of said upper end, first and second pairs of projections mounted on said geometric boundary and extending away from the receptacle, said projections engaging said outer faces of the bags to hold the bags, first means for supporting a first bag in said receptacle including one projection of each of said pairs, second means for supporting a second bag in said receptacle including the remaining projections of each of said pairs, the two projections of each said pairs being adjacent each other and comprising means so that the bags will be carried adjacent to each other in said receptacle, at least one projection on said geometric boundary spaced from said first means, for providing a further support for the first bag so that the first bag is held in the receptacle with an open upper end, and at least one projection on said geometric boundary spaced from said second means, for providing a further support for the second bag so that the second bag is held in the receptacle with an open upper end.

2. A device for holding at least two flexible bags each of which bags has an inner face and an outer face, comprising:

a receptacle having a bottom and also having a side wall extending upwardly from said bottom and having an upper end defining a geometric boundary, said side wall defining a single un-divided open cavity extending to at least the height of said upper end, first and second pairs of projections mounted on said geometric boundary and extending away from the receptacle, said projections engaging said outer faces of the flexible bags to hold the bags, first means for supporting a first bag in said receptacle including one projection of each of said pairs, second means for supporting a second bag in said receptacle including the remaining projections of each of said pairs, the two projections of each said pairs being adjacent each other and comprising means so that the bags will be carried adjacent to each other in said receptacle, said receptacle comprising additional means which in cooperation with the projections of said first means holds the first flexible bag in the receptacle with the upper end of the bag open.

3. A device as defined in claim 2 in which said receptacle also includes means which in cooperation with the projections of said second means holds a second flexible bag in the receptacle with the upper end of the bag open.

4. A device as defined in claim 2 in which said additional means comprises a portion of said receptacle.

5. A device as defined in claim 2, for holding three flexible bags, comprising:

said wall of said receptacle having first and second portions spaced apart sufficiently to receive the three flexible bags and said wall having third and fourth portions connecting said first and second portions together, said third portion having one of said pairs of projections and said fourth portion having the other pair of said projections, said pair of projections on said third portion and said pair of projections on said fourth portion being spaced far enough from said first portion so that one of said three flexible bags may be held by said first portion in cooperation with one projection of each of said pairs, an additional pair of projections on said third portion and an additional pair of projections on said fourth portion, said additional pairs of projections being spaced sufficiently from said first and second pairs of projections so as to hold a flexible bag between the first and second pairs of projections on the one hand and the two additional pairs of projections on the other hand, said two additional pairs of projections being sufficiently spaced from said second portion as to receive a flexible bag.

6. A device as defined in claim 5 in which the open cavity of the receptacle is elongated, with said third and fourth portions being longer than the first and second portions.

7. A device as defined in claim 2 in which said projections are wholly outside of said cavity and comprise rods mounted on and extending away from said upper end.

8. A device as defined in claim 7, comprising:

said receptacle being substantially rectangular in which said side wall comprises four generally vertical walls joined together, said projections being mounted on at least two of said walls in positions that at least partially hold two flexible bags in the receptacle.

9. A receptacle that holds at least two flexible bags, comprising:

said receptacle having a bottom and also having a side wall extending upwardly from said bottom and having an upper end, said side wall defining a single un-divided open cavity extending to at least the height of said upper end, first and second pairs of projections mounted on the upper end and extending away from the receptacle, said projections being wholly outside of said cavity, first and second flexible bags, first means for supporting said first bag in said receptacle including one projection of each of said pairs, and second means for supporting said second bag in said receptacle including the remaining projections of each of said pairs, the two projections of each said pairs being adjacent each other and comprising means so that the bags are carried adjacent to each other in said receptacle.

said bags having inner and outer faces, said projections engaging the outer faces of said bags.

10. A receptacle as defined in claim 9, in which said receptacle comprises means which in cooperation with said projections holds said bags in said receptacle with the upper ends of

11. A receptacle as defined in claim 9 in which at least some of said projections have a small curvature and wherein the curvature tends to retain the bags on the rods.

12. A receptacle as defined in claim 9 in which at least some of said projections are vertical and extend upwardly from said upper end.

13. A receptacle as defined in claim 9 in which at least some of said projections are horizontal.

14. A receptacle as defined in claim 9 in which at least some of said projections extend outwardly away from said upper end.

* * * * *